US006510280B1

(12) United States Patent
Chen

(10) Patent No.: US 6,510,280 B1
(45) Date of Patent: Jan. 21, 2003

(54) STRUCTURE OF STEAMER

(76) Inventor: Jen-Chieh Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/925,482

(22) Filed: Aug. 10, 2001

(51) Int. Cl.[7] ..... F24F 6/00
(52) U.S. Cl. ..... 392/402
(58) Field of Search ..... 392/324, 328, 392/336, 386, 394, 396, 397, 398, 399, 400, 401, 402, 403, 405, 406; 122/4 A, 450

(56) References Cited

U.S. PATENT DOCUMENTS 1,531,136 A * 3/1925 Robinson ..... 128/203.27
2,785,272 A * 3/1957 Baly ..... 137/614.2
3,365,567 A * 1/1968 Smith et al. ..... 122/448.1
3,581,529 A * 6/1971 Mitchell et al. ..... 15/302
3,654,780 A * 4/1972 Frank ..... 392/404
3,660,635 A * 5/1972 Liebert ..... 122/379
4,139,762 A * 2/1979 Pohrer et al. ..... 126/113
5,673,360 A * 9/1997 Scripps ..... 220/8
5,741,444 A * 4/1998 Kasuli ..... 261/128
5,881,207 A * 3/1999 DeBourg et al. ..... 340/618
6,115,539 A * 9/2000 Cohn ..... 392/402

* cited by examiner

*Primary Examiner*—Sang Paik
(74) *Attorney, Agent, or Firm*—Troxell Law Office PLLC

(57) ABSTRACT

An improved steamer (second application) has properties of small volume, no need of change water, fast speed of steam generation, save power, and essence therapy. The steamer includes a main body, a filter, a steam supply unit, and a control unit. Water input tube enters a steam generator of the main body through the filter. The steam generator is installed with an electric heater at the lower part. The heater is enclosed by mineral wool and has a temperature sensor and a water level detector. By controlling the water level in the steam generator and function of power safety cut, the generated steam is straddled out through the steam supply unit. Inside of the steam supply unit, it has two separated gas holes and a containing space. The essence is filled into the containing space, and can be evaporated together with the steam to be supplied from the gas holes.

4 Claims, 4 Drawing Sheets

STRUCTURE OF STEAMER

BACKGROUND OF THE INVENTION (a) Field of the Invention

The present invention is to provide a steamer with improved structure.

(b) Description of the Prior Art

Enjoying sauna bath becomes a popular activity for those who would like to relax themselves after they are off duties. Currently, those who are addicted to sauna bath would go to the public bathing facility or steam bath or buy a personal steaming box. However, the public steam generating system usually includes a boiler associating with an electronic control device for controlling the steam output. This kind of structure usually has large volume, occupying large space, not easy to move, and expensive. Usually, it needs a separated room to install it. Because of these reasons above, the steam bath so far cannot be applied for the whole family. It can therefore simply used by one person through the steam box. The steam box has large volume, occupying space, which is not easy to be stored. It usually has some difficulties to arrange a free space for installment. Also, the inconvenience that only one person can use the steam box at a time is inconvenient for all of the family members, which is the basic flaw.

Due to the foregoing reasons, the inventor has tried to use the manner of electric heater to generate steam. Even though the effect is good, it is troublesome to scour the steam generator (or water tank) due to the scale deposition or poor design for expelling water. Moreover, it also requires a proof not to cause insufficient water supply, which cannot satisfy the requirement for generating steam, and saving power consumption is another requirement, which require for instant solution.

Another thing is the inventor who also appreciates that the popular essence therapy can indeed relax our body to achieve the therapeutic effect. If the essence therapy can be performed together with the steam bath, out body can be effectively released and relaxed, so as to achieve the effect of health activities.

SUMMARY OF THE INVENTION

Therefore, the inventor under continuous test and design has provided an improved steamer (second application) has properties of small volume, no need of change water, fast speed of steam generation, save power, and essence therapy.

It is an object of the present invention to provide a structure of a steamer (second application) comprising a steam body, installed with an electronic control part, electric valve, and a steam generator, the steam generator inside having an electric heater, a water input part, a safe valve used for releasing steam when steam pressure is over high, and a steam tube used for supplying stream, wherein a water level detector is installed at a proper location used to control a water level of the steam generator, wherein the electronic control part has two power lines used to connect to a power source and a control unit, a filter, used to conduct water input from the steam generator for filtering, and conduct the water after filtering back to the steam generator again; a steam supply unit, which can be located at a desired place according to a location user, so as to connect to the steam through a tube route, and a control unit, used to control operation of the steamer.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
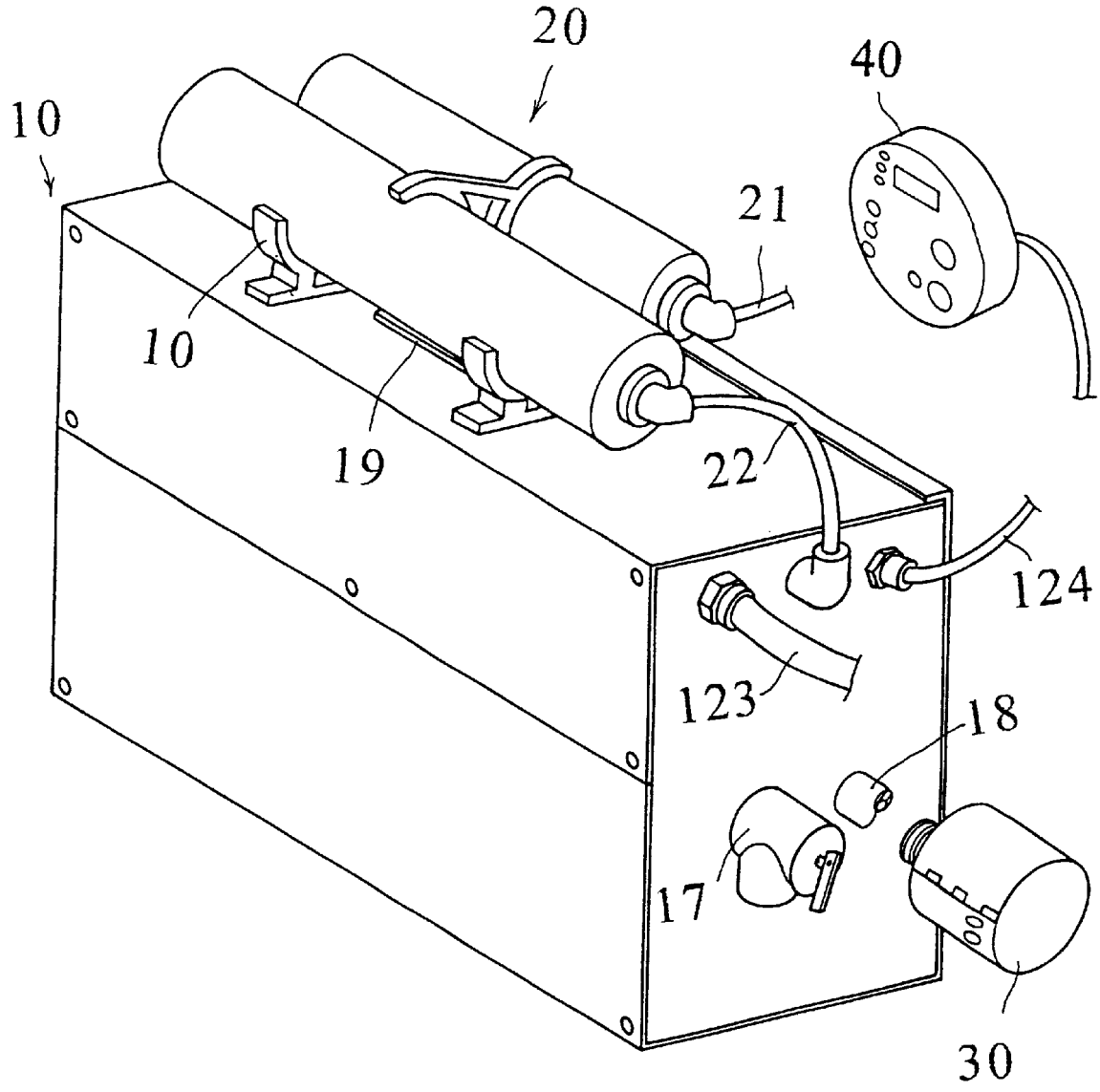
FIG. 1 is a perspective view, schematically showing the structure, according to a preferred embodiment of the invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 5:
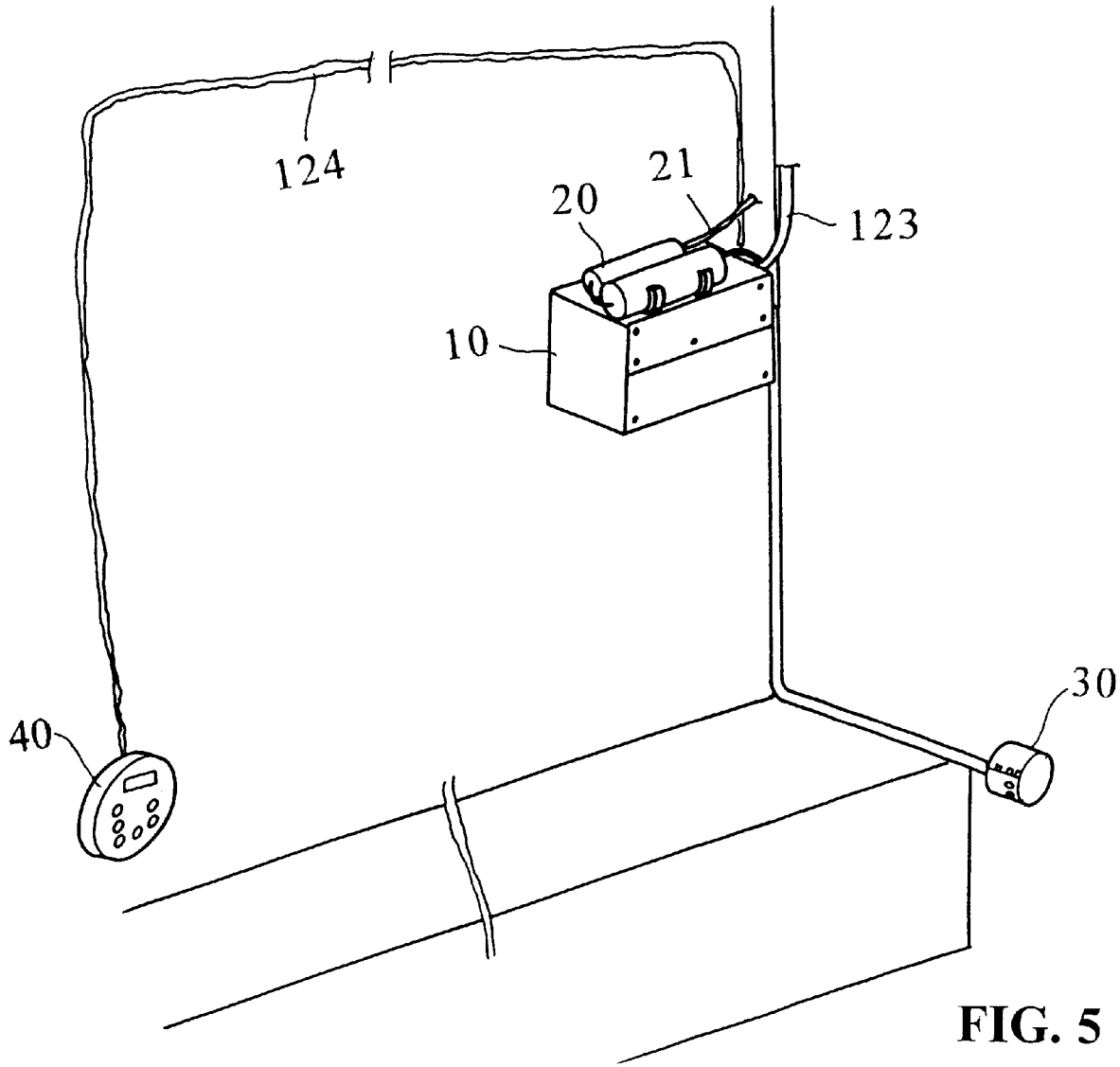
FIG. 5 is a drawing, schematically showing the steamer used in a hooking manner, according to a preferred embodiment of the invention.

The improved structure of steamer (second application) can achieve the foregoing beneficial strong points, and the structure includes a steam body 10, a filter 20, a steam supply unit 30, and a control unit 40. As shown in FIG. 1, an upper portion the steam body 10 is installed with a holder 101 to hold the filter 20 and a moveable handle bar 19. When the steam body is to be lifted up, it just simply needs to rotate the filter 20 to expose the handle bar 19. A hooking hole (not shown) is formed a back side panel, so that the user can take the manner to hook in a high level as shown in FIG. 5 or just put it on the plane.

Figure 2:
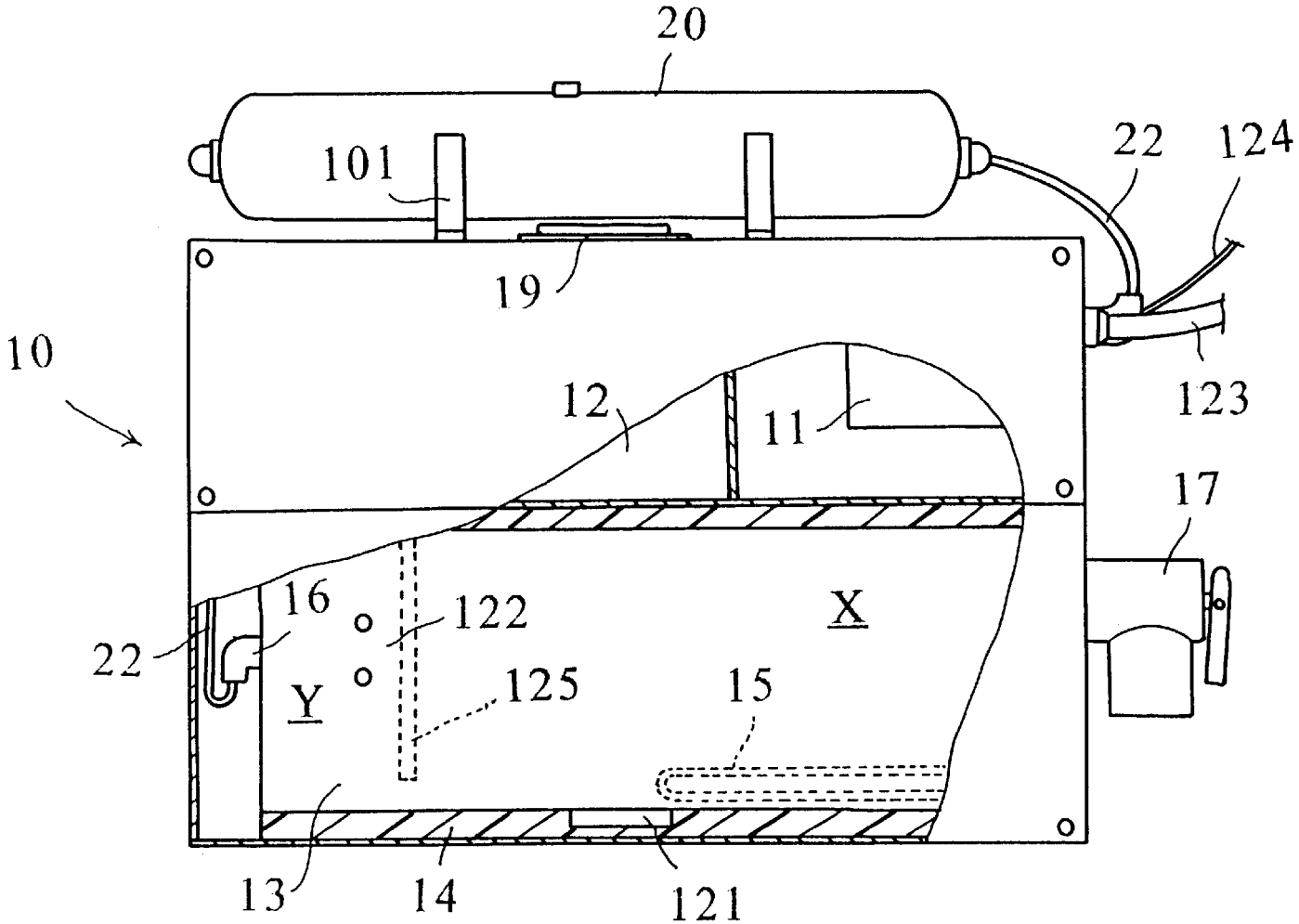
FIG. 2 is a cross-section view, schematically showing the structure, according to a preferred embodiment of the invention.

The inner structure of the steam body 10 is also shown in FIG. 2. The top portion is installed with an electric valve 11 and electronic control part 12, wherein the electric valve associates with the water level detector 122 to control the input flow of water. The steam generator 13 is located at the lower portion, in which the mineral wool or asbestos 14 encloses the steam generator 13. A water input part 16 is located at the left side, used for controlling the water flowing from the electric valve 11 to transport into the steam generator 13. A safe valve 17 extending from the steam body 10 is located at right side, used for controlling the steam pressure of the steam generator 13 to be at a certain range, so that the steam can be exported to the steam supply unit 30 through the steam tube 18. If the steam is generated too fast and not being complete exported at the steam supply unit 30, the steam under overpressure is exported from the safe valve 17, so as to reduce the steam pressure and recover to the normal condition for supplying steam. Moreover, an electric heater 15 is installed inside of the steam generator 13 and is located at the lower portion, so as to get a better convection effect due to the generated heat, a fast rate of steam generation, and save of power consumption.

In the forgoing, in order to maintain the water in the steam generator 13 at a certain range, it also includes a water level detector 122, separately arranged to have an upper and a lower detection points. Water supply stops when the water level is at the high state, and water is refilled when water level is at the low state to avoid the issue for too much water, which resulting in reduce of steam generating efficiency. In addition, it can be avoided that when the amount of water is insufficient, causing evaporation of water to be too fast, affecting the continuous steaming supplying. Moreover, in order to prevent the water of the steam generator 13 from being not normally supplied due to a stop of water, clog, or malfunction of the electric valve 11, filter 20 or any accidence causing water not being supplied in time according to the result of water level detector 122. Consequently, the steam generator 13 is continuously heated by the electric heater 15, causing danger. Because of these problems, a temperature sensor 121 is installed at outside of the steam generator 13 near to the electric heater 15, so as to detect the inner temperature of the steam generator 13. Once the steam generator 13 has no water or has insufficient water, the heater 15 continuously produces heat, and causes the abnormal high temperature. The temperature sensor 121 then instructs the control unit to cut the power, so as to achieve the purpose of save.

Moreover, in order to prevent the high temperature steam or water boiling from occurring due to the continuous action of electric heater 15 of the steam generator 13, and resulting in a damage or measurement error of the water level detector 122, a baffle 125 is installed at the water level detector 122 of the steam generator 13. Also and, a spacing is formed at the lower portion, so that the steam generator 13 is divided into a steam region X where the electric heater 15 can cause the high temperature steam, a low temperature water storing region Y where the steam is not directly generated, whereby the water level 122 can surely work under normal condition and detection capability.

The external connection part of the electronic control part 12 includes a first power line 123 and a second power line 124. The first power line 123 can be plugged into a socket, so as to provide power to the steamer. The second power line 124 is connected to the control unit 40, wherein the connecting manner can be a design like the phone terminal or the plug type, so as to freely disconnect for hoarding and assemble.

The water used by the steamer is supplied from outside through the filter 20. The filter 20 has a water inputting tube 21 for conducting the external water source to the filter 20, and a transporting tube 22 for exporting water to the steam body 10 under control of the electric valve 11. Consequently, the input water can be purified without producing water dirt. Even after the steam bath, the water is not necessary to be released. There is no need a conventional releasing valve.

Figure 3:
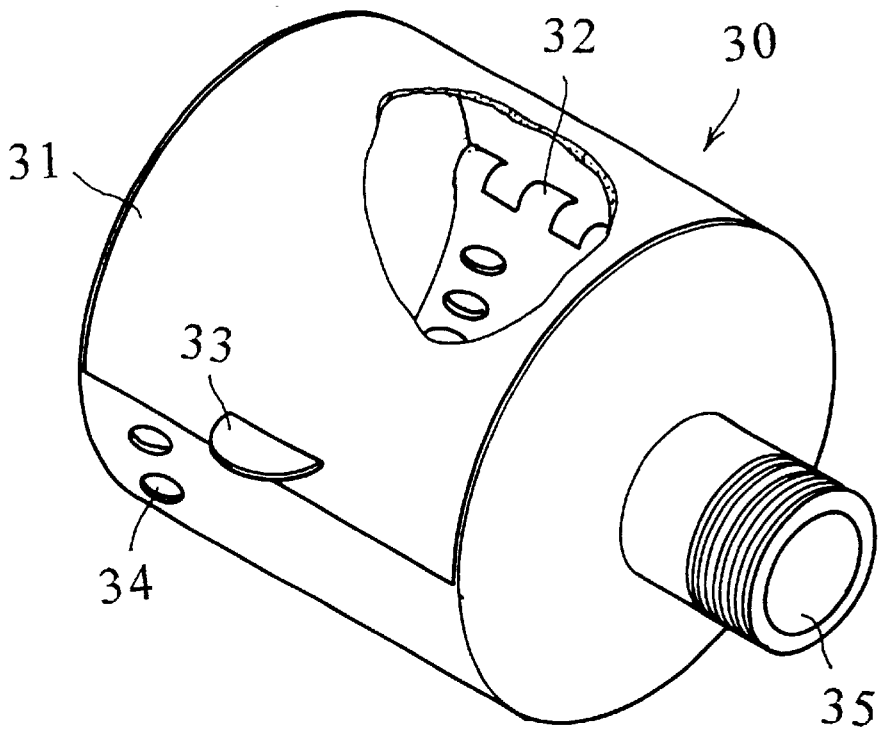
FIG. 3 is a perspective view, schematically showing the steam supply unit, according to a preferred embodiment of the invention.
Figure 4:
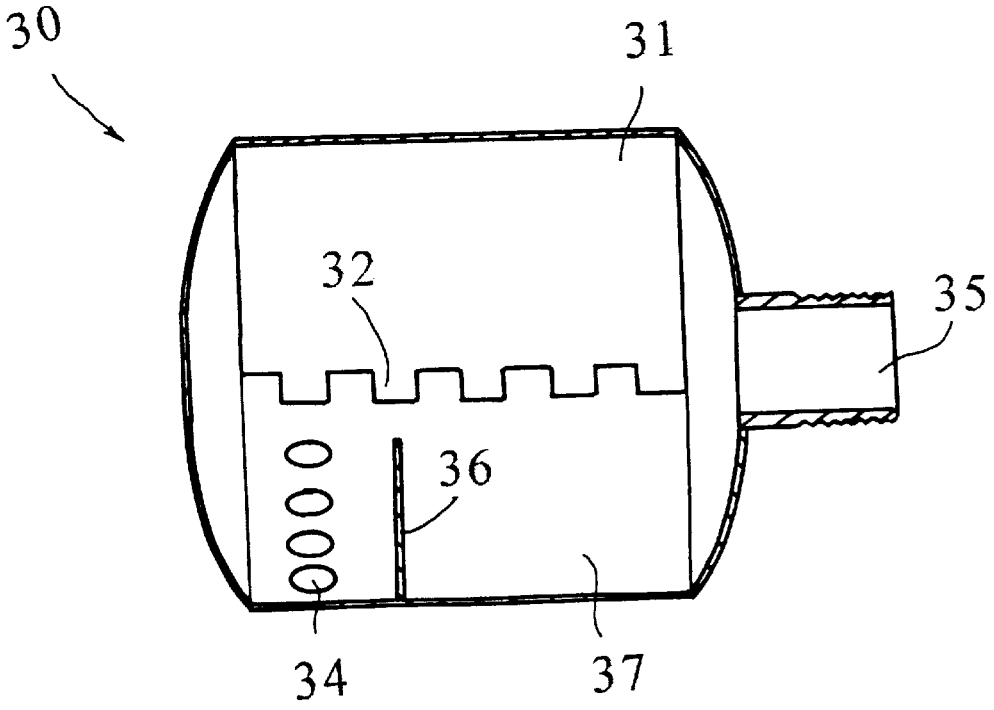
FIG. 4 is a cross-sectional view of the structure in FIG. 3.

The steam generated by the steam generator 13 is exported from the steam tube 18 located at the right side. The steam tube 18 is used for connection extension, so that the steam supply unit 30 can be located at a predetermined location. As shown in FIGS. 1 and 3–4, the steam supply unit 30 has the central free space. One side of the body has a tube body 35 used to connect the steam tube 18. The steam supply unit 30 has a covering body 31, which can be freely open, formed in a form of butt hinge 32. A plate body 33 is installed at front of the covering body 41, so as to allow the user to conveniently open the covering body 41. Several steam holes 34 are formed inner side with respect to a lower portion of the covering body 41. The steam hole 34 can release the steam that is input from the tube body 35. The steam hole 34 is designed to be located at a rather far end relative to the tube body 35. Another side then is separated out by the baffle plate 36, resulting in a containing space 37 near to the tube body 35, so that the containing spacer can be optionally filled with essence as desired. As the steam is conducted into the steam generator 30 through the tube body 35, the essence stored in the container spacer 37 is evaporated due to the effect of high temperature steam. In this manner, the steam bath and the essence therapy can simultaneously be performed.

When the invention of improved structure of steamer is operated, the steamer can be optionally put on a plane or hooked thereon, according to the practical consideration. As shown in FIG. 5, the steamer is mounted with the hook manner. The steamer of the invention can be installed in a public area or the bath room of a family for convenient use. In the example of FIG. 5, the second power line 124 of the control unit 40 is led to a far lower portion, to ease the user at the near place for controlling operation of the steam. The steam supply unit 30 is connected with the tube route at the lower portion. As a result, the steam and essence can effectively fill the whole room. The plate body 33, which covered by body 31, is located outside to prevent from occurring about accident opening by the user, and causing an abrupt increase of steam and an accidental damage. The first power line 123 is connected to the electric box or a power socket for supply power. The input tube 21 of the filter 20 is connected to the water faucet of external water source for supplying water.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A steamer comprising:

a) a steam body;

b) a water filter device located externally of the steam body, the water filter device including a water input tube and a water transporting tube;

c) a steam generator located within a lower portion of the steam body, the steam generator including a steam region and a water storing region, a baffle located between the steam region and the water storing region, the baffle being spaced from a bottom of the steam body such that the water storing region communicates with the steam region, the steam generator further including an electric heater in the steam region and a water level detector in the water storing region whereby the water transporting tube supplies water to the water storing region;

d) an electronic control device located within a top portion of the steam body;

e) an electric valve located within the top portion of the steam body;

f) a control unit located externally of and connected to, the steam body; and, g) a steam supply unit including a hinged, openable covering body and connected to the steam region of the steam body by a steam tube, the steam supply unit located exteriorly of the steam body.

2. The steamer of claim 1 further comprising:

a) a plurality of steam holes formed on the steam supply unit;

b) a tube body formed on an end of the steam supply unit in communication with an interior of the covering body; and, c) a baffle plate located internally of the steam supply unit between the end of the covering body housing the tube body and the plurality of steam holes.

3. The steam of claim 1, wherein the covering body includes an outwardly extending plate body to facilitate opening the covering body.

4. The steam of claim 1, further comprising a safe valve extending from the steam body and in communication with the steam region.

* * * * *